US007729099B2

(12) United States Patent
Kruska et al.

(10) Patent No.: US 7,729,099 B2
(45) Date of Patent: Jun. 1, 2010

(54) SURGE ARRESTER

(75) Inventors: Bernd Kruska, Berlin (DE); Erhard Pippert, Dallgow-Döberritz OT Seeburg (DE)

(73) Assignee: Siemens Aktiengesellschaft, Munich (DE)

( * ) Notice: Subject to any disclaimer, the term of this patent is extended or adjusted under 35 U.S.C. 154(b) by 114 days.

(21) Appl. No.: 11/938,838

(22) Filed: Nov. 13, 2007

(65) Prior Publication Data

US 2008/0291596 A1 Nov. 27, 2008

(30) Foreign Application Priority Data

Nov. 10, 2006 (DE) ..... 10 2006 053 986

(51) Int. Cl.
*H01C 7/12* (2006.01)

(52) U.S. Cl. ..... 361/127; 361/120

(58) Field of Classification Search ..... 361/118, 361/117, 127

See application file for complete search history.

(56) References Cited

U.S. PATENT DOCUMENTS 4,507,701 A * 3/1985 Fujiwara et al. ..... 361/127
4,509,090 A * 4/1985 Kawanami et al. ..... 361/119
4,527,215 A * 7/1985 Wessing ..... 361/124
4,740,859 A * 4/1988 Little ..... 361/56
4,788,622 A * 11/1988 Cinquin ..... 361/124
4,851,955 A * 7/1989 Doone et al. ..... 361/117
5,010,438 A * 4/1991 Brady ..... 361/56
5,136,460 A * 8/1992 Misencik et al. ..... 361/117
5,283,709 A * 2/1994 Shirakawa et al. ..... 361/117
5,341,271 A * 8/1994 Hutchinson ..... 361/123
5,400,207 A * 3/1995 Krause ..... 361/117
5,502,612 A * 3/1996 Osterhout et al. ..... 361/117
5,506,071 A * 4/1996 Tanaka et al. ..... 429/181
5,757,604 A * 5/1998 Bennett et al. ..... 361/127
5,766,517 A * 6/1998 Goedde et al. ..... 252/570
5,790,361 A * 8/1998 Minich ..... 361/111
5,936,826 A * 8/1999 Schmidt ..... 361/127
6,433,989 B1 8/2002 Hinrichsen et al.
2005/0034892 A1 * 2/2005 Philips et al. ..... 174/137 A

FOREIGN PATENT DOCUMENTS

DE 19728961 A1 2/1999

* cited by examiner

*Primary Examiner*—Stephen W Jackson
*Assistant Examiner*—Angela Brooks
(74) *Attorney, Agent, or Firm*—Laurence A. Greenberg; Werner H. Stemer; Ralph E. Locher

(57) ABSTRACT

A surge arrester has a discharge current path. The discharge current path is surrounded by an insulating sleeve. The insulating sleeve has at least one area that is optically transparent.

9 Claims, 2 Drawing Sheets

SURGE ARRESTER

CROSS-REFERENCE TO RELATED APPLICATION

This application claims the priority, under 35 U.S.C. §119, of German application DE 10 2006 053 986.9, filed Nov. 10, 2006; the prior application is herewith incorporated by reference in its entirety.

BACKGROUND OF THE INVENTION

Field of the Invention

The invention relates to a surge arrester having a discharge current path, and an insulating sleeve which surrounds the discharge current path.

A surge arrester of the type is known, for example, in German published specification DE 197 28 961 A1, which describes a surge arrester for high-voltage or medium-voltage, which has a discharge current path within an insulating sleeve in the form of part of a gas-tight encapsulating housing. A sensor is disposed within the encapsulating housing and monitors a temperature. The prior art configuration provides for an antenna to be integrated in the discharge current path in order to transmit information from the interior of the encapsulating housing. The antenna interacts with the sensor. A secondary power supply is required in order to operate the sensor and in order to transmit information by means of the antenna. The sensor, the antenna as well as devices for the secondary power supply represent comparatively complex electrical arrangements. Information transmitted via the antenna can admittedly be processed in automated form, for example in control systems, but this is unnecessary for a comparatively large number of applications. In fact, all that need be provided for a multiplicity of applications is simple monitoring of a surge arrester, and information about the status of the surge arrester.

SUMMARY OF THE INVENTION

It is accordingly an object of the invention to provide a surge arrester, which overcomes the above-mentioned disadvantages of the heretofore-known devices and methods of this general type and which allows cost-effective transmission of information from its interior.

With the foregoing and other objects in view there is provided, in accordance with the invention, a surge arrester, comprising:

a discharge current path;

an insulating sleeve surrounding said discharge current path; and said insulating sleeve being formed with at least one optically transparent area.

In other words, the objects of the invention are achieved in the case of a surge arrester of the type mentioned in the introduction in that the insulating sleeve has at least one area which is optically transparent.

Surge arresters according to the invention, which may also be referred to as lightning arresters, are used in many network levels of electrical power transmission networks. For example, surge arresters may be used in the medium-voltage, high-voltage and very-high-voltage ranges. Surge arresters are in this case used essentially to dissipate overvoltages which occur in the respective section of the electrical power transmission system. Overvoltages such as these may be caused, for example, by switching processes, lightning strikes, or the like. During a discharge process, increased temperatures can occur in the interior of the surge arrester. This is dependent in particular on current heating effects. Furthermore, surge arresters are also subject to climatic loads so that these can also cause damage to a surge arrester.

By way of example, the invention can be used for surge arresters in which the insulating sleeve of the surge arrester is part of a gas-tight encapsulating housing, with a fluid-filled volume being provided for isolation purposes between the discharge current path and the insulating sleeve. The fluid may decompose as a result of aging processes, or foreign substances can enter the fluid over the course of years, as a result of leaks. Electrically negative gases such as sulfur hexafluoride, nitrogen or the like are typically used for fluids. Furthermore, however, it is also possible to use liquids such as insulating oils. The provision of an area which is optically transparent in the insulating sleeve makes it possible, for example, to use optical aids to inspect the fluid. For example, precipitation can be detected visually from the outside in liquid insulating media. Furthermore, for example, it is also possible to identify an accumulation of liquids, for example condensed water, when using gaseous insulating media.

Furthermore, it is also possible to visually inspect the discharge current path. For example, this allows corrosion phenomena, hairline cracks etc. to be identified on the discharge current path. For example, suitable recording appliances, such as cameras or the like, can be used to monitor the interior of the surge arrester in a simple manner through the optically transparent area. In this case, provision should be made for the optical transparency to be provided in the wavelength range that is known as optical radiation. Optical radiation is understood to cover radiation from ultraviolet radiation via visible light to infrared radiation.

In particular, it is advantageously possible to provide for the area to be transparent for visible light.

The use of an area which is transparent for visible light, that is to say for electromagnetic radiation at wavelengths from about 400 nanometers to about 700 nanometers, allows the interior of the surge arrester to be seen, and changes to be detected, with the human eye. This means that it is possible to subject even low-cost surge arresters to routine monitoring without having to provide complex test and monitoring apparatuses.

A further advantageous refinement makes it possible to provide for an indicator of a monitoring device to be arranged on a side of the insulating sleeve facing the discharge current path, with respect to an axis which intersects the area.

An indicator on the inside of the insulating sleeve, that is to say on the side of the insulating sleeve facing the discharge current path with respect to an axis which intersects the area, allows easier perception of changes in the interior of the insulating sleeve. By way of example, moisture indicators, heat indicators, pressure indicators, vibration indicators etc. can be provided as indicators. By way of example, a filter material which exhibits a color change as its saturation increases can be arranged in the interior of the insulating sleeve, as a moisture indicator. The color change can be perceived through the area, so that it is possible to deduce the moisture content in the interior of the insulating sleeve. In a physically simple case such as this, the indicator and the monitoring device are combined. Furthermore, it is also possible to provide for the temperature in the interior of the insulating sleeve to be monitored. Temperature-sensitive coatings can be used as indicators for this purpose. The coatings may, for example, be applied directly to sections of the discharge current path. Different indications on the indicator may be produced, depending on the temperature. However, it is also possible to provide for the indicator to change color permanently on reaching a limit temperature. In the simplest case, the discharge current path may exhibit corresponding structure changes on its surface in the event of overheating, or an appropriate coating can be provided there.

Vibration monitoring is particularly advantageous during transportation. Materials used for the discharge current path may, for example, be formed by sintering processes. Bodies such as these may in some circumstances be sensitive to fracture, so that the occurrence of impact can endanger the effectiveness of the discharge current path. Indicator manipulations are virtually impossible as a result of an appropriate indicator being arranged in the interior of the insulating sleeve. Furthermore, an indicator such as this can also remain permanently in the surge arrester during operation. Mechanical forces acting on the surge arrester can therefore also be monitored during operation.

In addition to so-called passive monitoring devices and corresponding indicators, it is also possible to use active monitoring devices. Active monitoring devices may, for example, be electronic circuits which have appropriate optical indicating means, such as light-emitting diodes or LCD displays, as indicators. Optical indicators such as these may advantageously themselves be at least part of the optically transparent area and, in particular, may be inserted in a gas-tight manner into the insulating sleeve.

It is advantageously possible to provide for the monitoring device to monitor the moisture content of a medium which surrounds the discharge current path.

Surge arresters with a discharge current path and an insulating sleeve which surrounds the discharge current path may be physically designed such that the insulating sleeve is arranged at a distance from the discharge current path. In order to ensure the isolation resistance between the insulating sleeve and the discharge current path, the space can be filled with an electrically negative gas, as described above. In this case, the insulating sleeve may be part of a gas-tight encapsulating housing. Despite very careful design and production processes, the ingress of moisture cannot be precluded, as a result of aging phenomena. The moisture which has entered has a negative influence on the insulating capability of the gas, so that the dielectric strength of the surge arrester is endangered. It is therefore particularly advantageous in designs such as these to monitor the moisture content of the medium which surrounds the discharge current path.

It is advantageously possible to provide for the area to have a sight glass or viewing glass which is inserted into the insulating sleeve.

A viewing glass makes it possible to provide an optically transparent area even on existing structure and existing surge arresters. By way of example, the viewing glass can be fitted into a recess thus providing a visual axis into the interior of the surge arrester. In this case, a viewing glass should be connected to the insulating sleeve to be as gas-tight as possible. Appropriate socket fittings can be used for this purpose. Depending on the design configuration of the surge arrester, it is also possible to use a plurality of viewing glasses in the insulating sleeve. This means that it is possible, for example, to arrange a plurality of indicators in the interior of the insulating sleeve, and for these to be used to detect different physical variables.

A further advantageous refinement makes it possible to provide for the insulating sleeve to be optically transparent.

An optically transparent configuration of the insulating sleeve means that there is no need to install separate viewing glasses. This makes it possible to make relatively large areas of the interior of a surge arrester visible from the outside. In addition to monitoring physical variables, this also makes it possible to carry out quality control of the assembly of the surge arrester through the insulating sleeve. Depending on the purpose, the degree of absorption of the optically transparent insulating sleeve may vary. For example it is also possible to provide for the optically transparent insulating sleeve to have a comparatively high absorption degree, and for sight glasses with a lower absorption degree to be additionally inserted at specifically points into the optically transparent insulating sleeve.

It is advantageously also possible to provide for the insulating sleeve to be at least partially composed of silicone.

Insulating sleeves may be formed from liquid silicone which cures after reaching its final shape. In this case, it is advantageous to avoid gas enclosures in the insulating sleeve. Gas enclosures such as these can adversely affect the dielectric strength of the insulating sleeve. Enclosures such as these can be seen from the outside as a result of the provision of an appropriately optically transparent silicone. This additionally makes it possible to monitor the manufacturing quality of insulating sleeves. It is possible to provide for the insulating sleeve composed of silicon to be applied to the discharge current path. In this case, there should ideally be no gas enclosures whatsoever in the interior of the surge arrester. However, it is also possible to provide for the insulating sleeve to be fitted to a mounting element, for example a glass-fiber-reinforced tube. In this case, it is possible to provide for the indicators to be integrated, for example, in the glass-fiber-reinforced tube. The appropriate transparent configuration of the insulating sleeve composed of silicone allows the indicators to be seen visually from the outside.

A further advantageous refinement makes it possible to provide for the insulating sleeve to be provided with ribs on a side facing away from the discharge current path.

The provision of ribs on the outer surface of the insulating sleeve prepares the surge arrester for installation in outdoor conditions. The ribs lengthen and interrupt a creepage path on the surface for any creepage currents which may occur. In this case, for example, the ribs may be formed from a multiplicity of axially separated ribs. However, it is also possible to provide for a single rib to run circumferentially around the insulating sleeve, in the form of a helix.

In this case, it is advantageously possible to provide for the insulating sleeve to have a tubular structure.

A tubular insulating sleeve structure makes it possible to form an elongated discharge current path and to surround this coaxially with an insulating sleeve. This design results in a dielectrically advantageous arrangement.

Furthermore, it is advantageously possible to provide for the insulating sleeve to be an intrinsically stable body.

By way of example, an intrinsically stable body may be formed by the use of materials which cure to be solid, such as porcelains or resins. However, it is also possible to provide for the use of permanently elastic materials, such as silicones, rubbers etc., with an appropriate strength so that they remain elastic and in the process form a largely stable molding.

The use of an intrinsically stable body makes it possible to stabilize the overall arrangement of a surge arrester. Furthermore, the insulating sleeve can be used to position a discharge current path.

In addition, it is advantageously possible to provide for the discharge current path to have at least one varistor element.

Surge arresters are generally included in the ground-fault current path, which leads to a ground potential from an electrical conductor which is used to transmit electrical power within an electrical power transmission system. Varistor elements can be used to switch the discharge current path as required, in order to prevent the formation of a permanent ground-fault current path. The surge arrester can now allow a discharge current to flow, or can interrupt a discharge current, in the form of a valve, depending on the appropriately chosen limit voltage. This means that it is possible to arrange a system within an electrical power transmission system, which reacts automatically to overvoltages that occur and dissipates them by initiation of a discharge current. The ground-fault current path is interrupted by permanently reducing the overvoltage.

Other features which are considered as characteristic for the invention are set forth in the appended claims.

Although the invention is illustrated and described herein as embodied in surge arrester, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
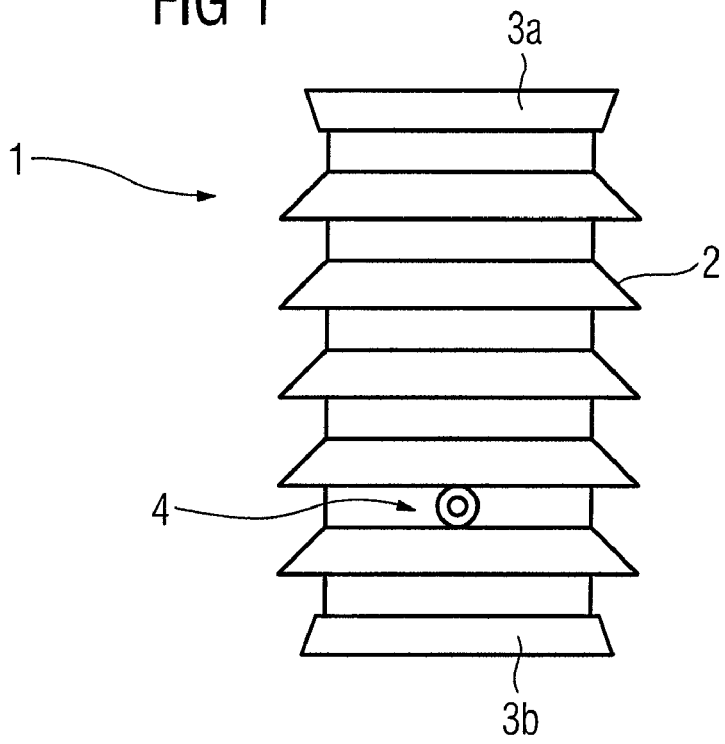
FIG. 1 shows a view from the outside of a first variant of a surge arrester according to the invention with a viewing glass.

Referring now to the figures of the drawing in detail and first, particularly, to FIG. 1 thereof, there is shown a view from the outside of a first variant of a surge arrester 1 according to the invention. The surge arrester 1 has an insulating sleeve 2. In the present case, the insulating sleeve 2 is formed by an intrinsically stable body, which is manufactured from a porcelain. However, it is also possible to provide for a plastic composite body to be used rather than porcelain. A plastic composite body such as this may, for example, have a glass-fiber-reinforced mounting tube to which shielding composed of (possibly optically transparent) silicone is applied.

The insulating sleeve 2 is substantially rotationally symmetrical and has a cylindrical accommodation area in its interior. At the end, the insulating sleeve is provided with connecting fittings 3*a*, 3*b*. The connecting fittings 3*a*, 3*b* are manufactured from electrically conductive material, for example cast aluminum or cast copper, and are used to make electrical contact with a ground point or a surge-arresting cable. A sight glass or viewing glass 4 is inserted into the insulating sleeve 2, passing radially through the insulating sleeve 2. The viewing glass 4 is introduced into the insulating sleeve 2 by means of a socket, such that it is gas-tight. This does not adversely affect the gas-tightness of the insulating sleeve 2. The connecting fittings 3*a*, 3*b* seal the insulating sleeve 2 to be gas-tight, in the same way that the viewing glass 4 is connected to the insulating sleeve 2 in a gas-tight manner. The accommodation area that is available in the interior of the insulating sleeve 2 is thus sealed against external influences, such that it is gas-tight.

Figure 2:
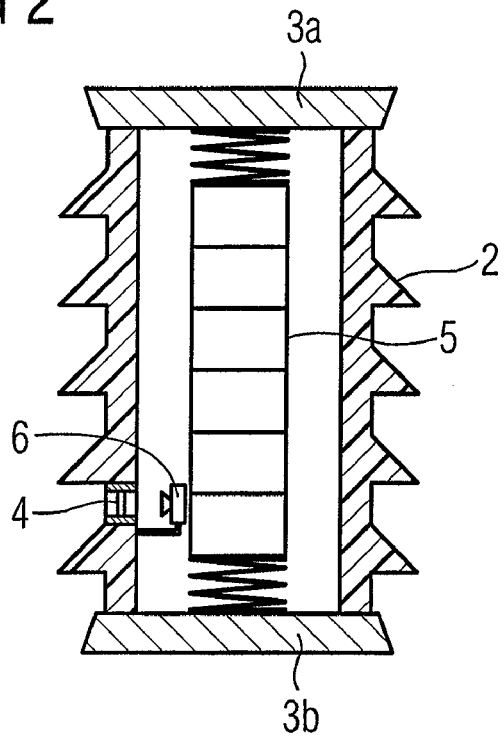
FIG. 2 is a section taken through the first variant of a surge arrester with a viewing glass.

FIG. 2 shows a section through the first variant of the surge arrester 1 of FIG. 1. A discharge current path 5 is arranged between the connecting fittings 3*a*, 3*b*. The discharge current path 5 has a plurality of varistor elements which are clamped in between the connecting fittings 3*a*, 3*b* by means of resilient elements. The accommodation area can be viewed through the viewing glass 4. On the one hand, this makes it possible to see the insulating medium which surrounds the discharge current path 5, and it is also possible visually to examine the discharge current path 5, at least in places. In the present case, a monitoring device 6 with an indicator is also provided, and can likewise be seen through the viewing glass 4, which is used as the optically transparent area. Together with the indicator, the monitoring device 6 is in the present case attached to the insulating sleeve 2. However, it is also possible to provide for alternative forms of attachment. For example, the monitoring device 6 may be fitted directly to the discharge current path 5. Different physical variables can be monitored in the interior of the surge arrester 2 by means of one or more monitoring devices 6. Exemplary such parameters are moisture, temperature, and pressure, by way of example.

Figure 3:
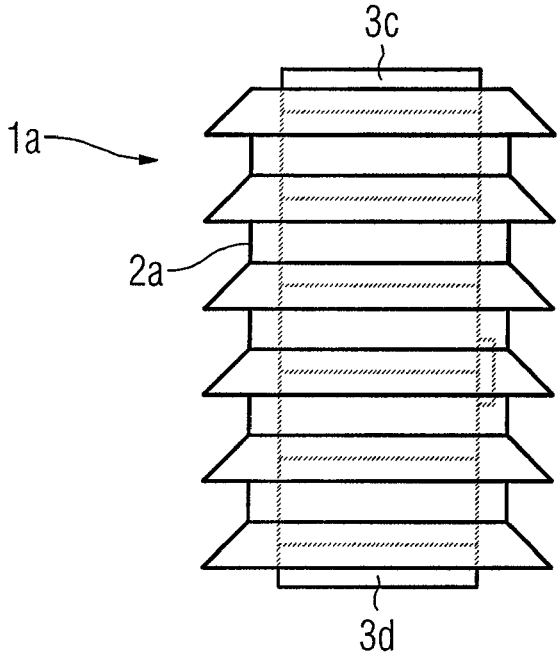
FIG. 3 is a view from the outside of a second variant of a surge arrester according to the invention.
Figure 4:
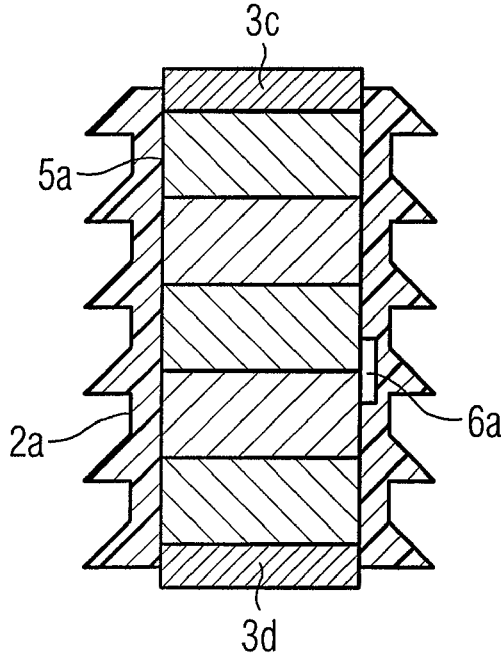
FIG. 4 shows a section through the second variant of a surge arrester.

The second variant of a surge arrester 1*a*, as illustrated in FIGS. 3 and 4, has a physical design which differs from that of the first variant. In the second embodiment variant of the surge arrester 1*a*, a discharge current path 5*a* forms a mechanically strong core, which is surrounded by an insulating sleeve 2*a*. As can be seen in the section illustration in FIG. 4, the discharge current path 5*a* once again has a multiplicity of varistor elements, with connecting fittings 3*c*, 3*d* being arranged at the ends. The connecting fittings 3*c*, 3*d* are normally connected to one another by means of bracing elements, with the bracing elements being pressed against one another with interposition of the varistor elements in the discharge current path 5*a*. This results in an intrinsically stable core. An insulating sleeve 2*a* is fitted to the discharge current path 5*a*, as far as possible free of enclosures. The insulating sleeve 2*a* is formed essentially from a transparent silicone so that, as is shown in FIG. 3, the discharge current path 5*a* as well as the sections of the connecting fittings 3*c*, 3*d* which are surrounded by the insulating sleeve 2*a* can be viewed through the insulating sleeve 2*a*. The insulating sleeve 2*a* is provided with ribs in order to improve the resistance to weather.

A monitoring device 6*a* is arranged in the contact area of the insulating sleeve 2*a* on the discharge current path 5*a*. The monitoring device 6*a* is, for example, embedded therein while the discharge current path 5*a* is being extrusion-coated with the insulating sleeve 2*a*. In this case, the monitoring device 6*a* can monitor a wide range of different physical variables, for example as described with reference to the first variant of the surge arrester 1. Since the insulating sleeve 2*a* is manufactured from a transparent silicone, the monitoring device 6*a* may be viewed from different viewing angles. This makes it possible to position monitoring devices 6*a* and indicators at various points on monitoring devices. As already described with reference to the first variant of the surge arrester 1, widely different types of design can be used for the monitoring device.

In this case, both active monitoring devices (which require secondary power) and passive monitoring devices with appropriate indicators may be used.

The invention claimed is:

1. A surge arrester, comprising:

a discharge current path;

an insulating sleeve surrounding said discharge current path, said insulating sleeve being formed with at least one optically transparent area being transparent for visible light; and an indicator of a monitoring device disposed on a side of said insulating sleeve facing said discharge current path, with respect to an axis that intersects said optically transparent area.

2. The surge arrester according to claim 1, wherein said monitoring device is configured to monitor a moisture content of a medium surrounding said discharge current path.

3. The surge arrester according to claim 1, wherein said optically transparent area has a viewing glass inserted into said insulating sleeve.

4. The surge arrester according to claim 1, wherein said insulating sleeve is formed from an optically transparent material.

5. The surge arrester according to claim 1, wherein said insulating sleeve is at least partially composed of silicone.

6. The surge arrester according to claim 1, wherein said insulating sleeve is formed with ribs on a side facing away from said discharge current path.

7. The surge arrester according to claim 1, wherein said insulating sleeve has a tubular structure.

8. The surge arrester according to claim 1, wherein said insulating sleeve is an intrinsically stable body.

9. The surge arrester according to claim 1, wherein said discharge current path includes at least one varistor element.

* * * * *